United States Patent [19]

Cleminson

[11] 4,196,850

[45] Apr. 8, 1980

[54] MODEL RAILWAY TRACK

[75] Inventor: Douglas J. Cleminson, Birchington-on-Sea, England

[73] Assignee: Rovex Limited, Margate, England

[21] Appl. No.: 917,326

[22] Filed: Jun. 20, 1978

[30] Foreign Application Priority Data

Sep. 27, 1977 [GB] United Kingdom ..... 40200/77

[51] Int. Cl.[2] ..... A63H 19/30

[52] U.S. Cl. ..... 238/10 E; 238/10 R

[58] Field of Search ..... 238/10 R, 10 A, 10 B, 238/10 C, 10 E, 10 F

[56] References Cited

U.S. PATENT DOCUMENTS

| | | | |
|---|---|---|---|
| 1,076,044 | 10/1913 | Kintner | 238/10 C |
| 2,952,411 | 9/1960 | Hand | 238/10 R |
| 3,464,624 | 9/1969 | Christiansen | 238/10 E |
| 3,592,384 | 7/1971 | Tomaro | 238/10 E |
| 3,684,173 | 8/1972 | Casadio | 238/10 E |

*Primary Examiner*—John A. Pekar
*Assistant Examiner*—Ross Weaver
*Attorney, Agent, or Firm*—Wigman & Cohen

[57] ABSTRACT

A model railway track component or unit comprises a unitary structure made of moulded synthetic plastics material and having a sleeper portion and two resiliently deformable rail-forming portions of unequal length extending in opposite directions from respective ends of the sleeper portion. The unequal length of the rail-forming portions is such as to permit two such components or units to be coupled together alternatively in a complementary reverse aspect for the formation of a straight length of track, or in a common aspect by deformation of the rail-forming portions for the formation of a curved length of track.

6 Claims, 5 Drawing Figures

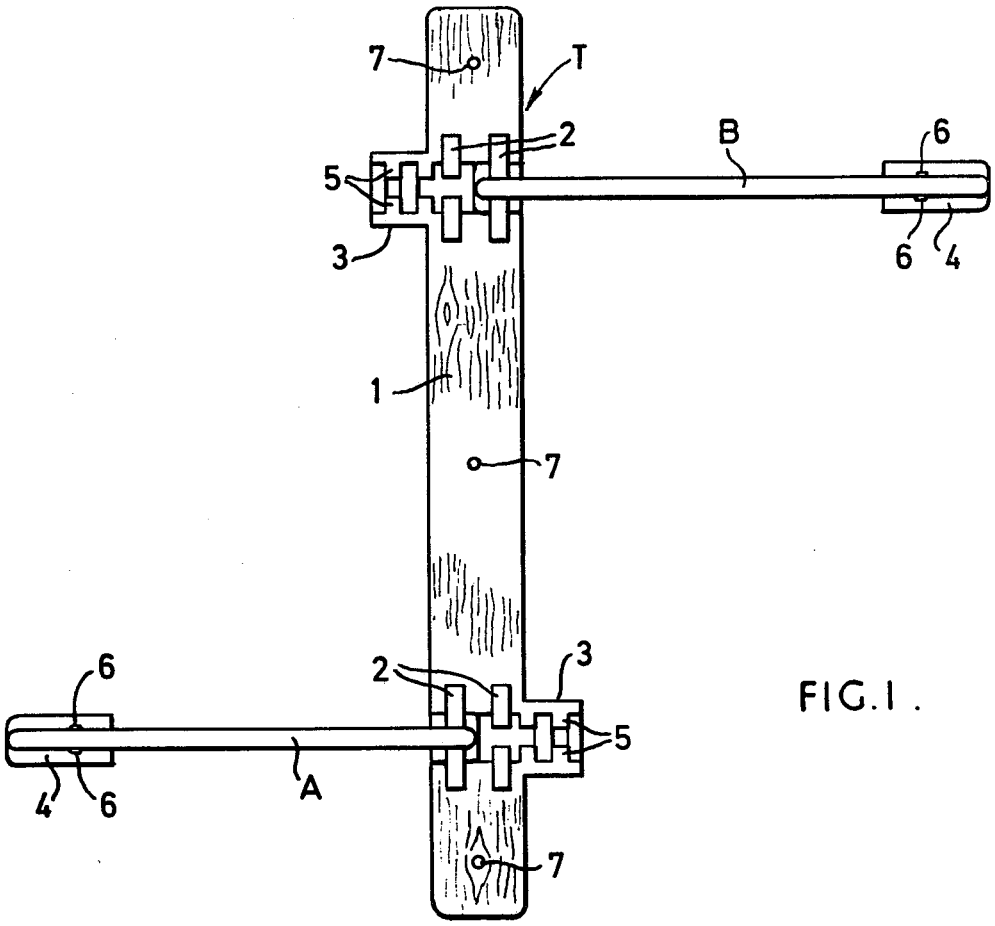
FIG. 1.
FIG. 2.
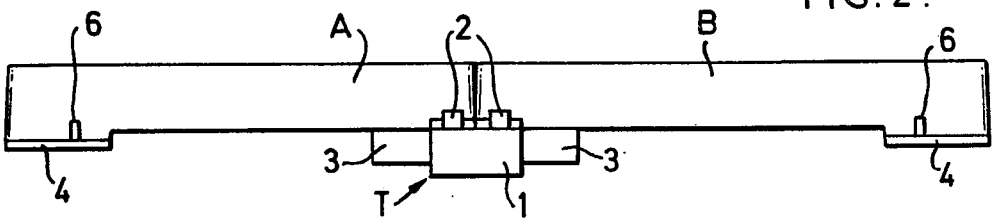
FIG. 3.
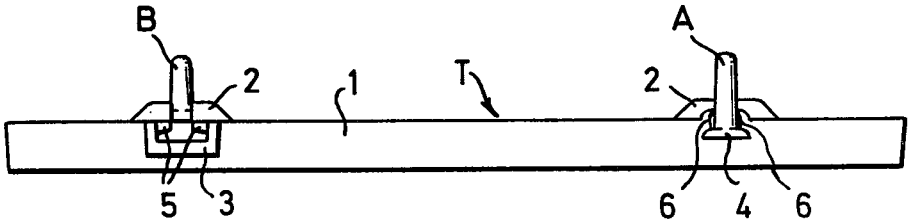

MODEL RAILWAY TRACK

BACKGROUND OF THE INVENTION

This invention relates to track for model railways and has been devised with the general object of providing a track component or unit which, in association with one or more similar units, can be used alternatively to form straight or curved lengths of track as may be required.

A track system for model vehicles has to comprise, inter alia, straight sections of varying lengths and curved sections of varying radii to enable a circuit to be built within an available space.

It is expensive to tool up for these varieties of parts and it is difficult for the manufacturer to know how many of each to make relative to the others and equally for the retailer to know how many or each to buy. Further, the consumer is limited in the variety of circuits he can construct by the quantity of each section which he possesses.

OBJECTS AND SUMMARY OF THE INVENTION

The general object of the present invention is to overcome the foregoing difficulties by providing only one unit of track which, depending on the way it is assembled to its neighbours, enables the user to make up straight or curved lengths in an almost unlimited variety of configurations.

In accordance with the invention therefore a model railway track component or unit comprises a unitary structure made of moulded synthetic plastics material and having a sleeper portion and two resiliently deformable rail-forming portions of unequal length extending in opposite directions from respective ends of the sleeper portion, the unequal length of the rail-forming portions is such as to permit two such components or units to be coupled together alternatively in a complementary reverse aspect for the formation of a straight length of track, or in a common aspect by deformation of the rail-forming portions for the formation of a curved length of track.

Preferably the synthetic plastics material is an acetyl resin or high density polyethylene and the ends of the sleeper portion are formed with recesses for lockably receiving complementary terminal portions of the rail-forming portions of an adjacent identical component or unit.

BRIEF DESCRIPTION OF THE DRAWINGS

A typical track component or unit in accordance with the invention — and its mode of use — is hereinafter described with reference to the accompanying drawings, in which:

FIG. 1 is a plan view of the unit;

FIG. 2 is a side view of the unit;

FIG. 3 is an end view of the unit; and

DETAILED DESCRIPTION OF A PREFERRED EMBODIMENT

Figure 4:
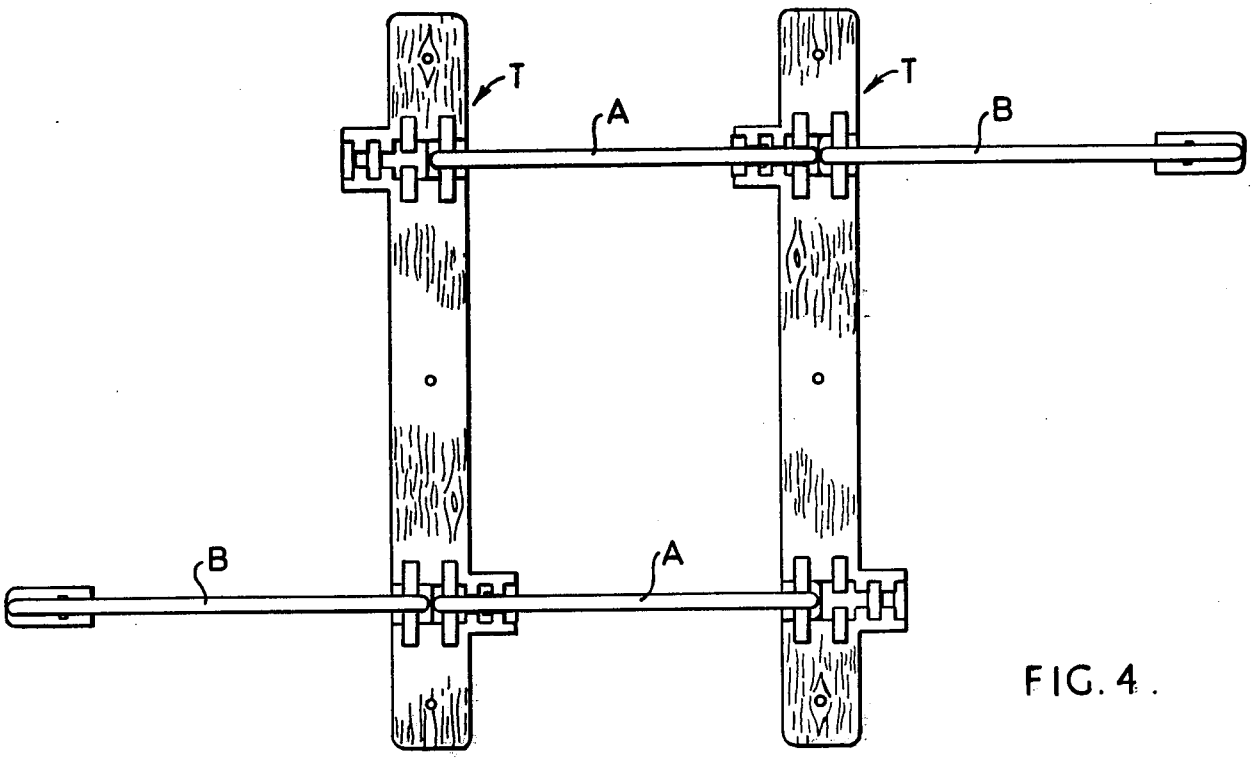
FIGS. 4 and 5 are plan views showing alternate modes of coupling two units as shown in FIGS. 1 and 3.

Referring firstly to FIGS. 1 to 3 the model railway track unit therein shown is a unitary moulding of a somewhat resilient synthetic plastics material such as one of those mentioned above. The unit comprises a sleeper portion 1 from which rail portions A and B extend in opposite directions. The sleeper portion is formed with rail chairs 2, and with bearers 3 which are recessed for slidable receiving base flanges 4 formed at the free ends of the rail portions A and B of identical units. Each bearer 3 has a pair of opposite deformable locking fingers 5 which are adapted to co—operate with pairs of stops 6 on opposite sides of the rail portion ends of identical units to lock the units one to another. The sleeper portion also has three holes 7 for receiving the shanks of fixing pins.

The main characterising feature of the unit is that the rail portions A and B are of different length, the difference being a function of the gauge of the track and the required radius of the track curves.

The unit which is shown could be suitable for the formation of a 3½" gauge 3½ foot radius track layout. The sleeper portion 1 of the component is 6 inches long and 0.625 inches wide and the length of one rail portion (A), measured from the longitudinal centre line of the sleeper portion 1, is 3.156 (3⅛") inches whilst the length of the other rail portion (B) is 3.440 (3⅜") inches.

FIG. 4 shows how units are coupled together in a complementary reverse aspect to form a straight length of track, the rail portions A and B of respective units being straight, parallel and undeformed.

Figure 5:
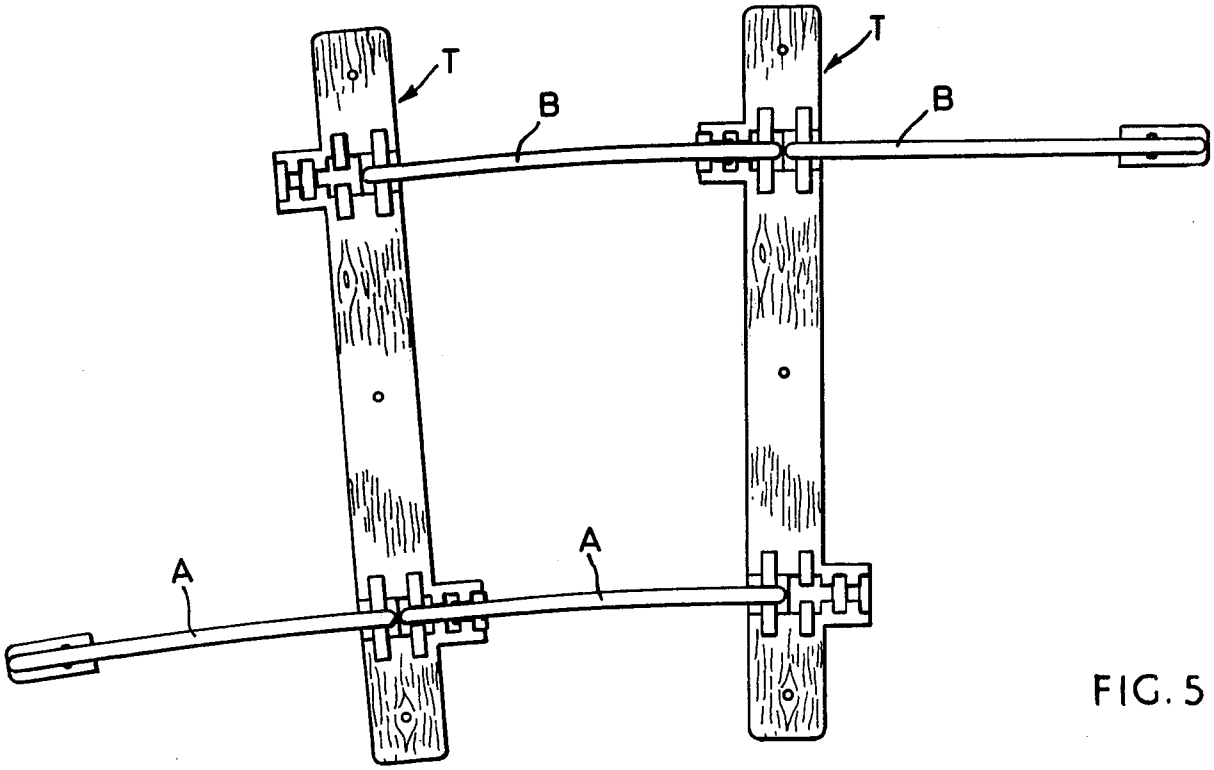

FIG. 5 however shows how units are coupled together in a common aspect to form a curved length of track, the rail portions A and B of respective units being slightly deformed into concentric curves.

Using a plurality of identical units as described, and by suitable selection of their modes of coupling, as explained it will be readily apparent that a wide variety of track configurations can be achieved.

I claim:

1. A model railway track component or unit comprising a unitary structure made of moulded synthetic plastics material and having a sleeper portion and two resiliently deformable rail-forming portions of unequal length extending in opposite directions from respective ends of the sleeper portion, the unequal length of the rail-forming portions being such as to permit two such components or units to be coupled together alternatively in a complementary reverse aspect for the formation of a straight length of track or in a common aspect by deformation of the rail-forming portions for the formation of a curved length of track.

2. A model railway track component or unit according to claim 1 wherein the ends of the sleeper portion have recessed parts for lockably receiving complementary terminal portions of the rail-forming portions of an adjacent identical component or unit.

3. A model railway track component or unit according to claim 2 wherein each recessed part is a bearer having inwardly directed fingers adapted to co—operate with stop members formed adjacent the end of a rail-forming portion of an identical component or unit.

4. A model railway track component or unit according to claim 2 wherein each recessed part includes vertically spaced upper and lower members defining a longitudianal opening for slidably receiving the end of a rail-forming portion of an identical component or unit.

5. A model railway track component or unit according to claim 4 wherein the end of said rail-forming portion includes a lower base flange which is adapted to slide into said sleeper recessed part, stop means provided adjacent said flange for restraining relative movement of said interconnected sleeperrail members.

6. A model railway track component or unit according to claim 5 wherein said sleeper portion includes opposing rail chairs positioned above said recessed part for receivingly positioning the upper end of a next adjacent rail-forming portion.

* * * * *